US011661255B1

(12) United States Patent
Bertelsman

(10) Patent No.: US 11,661,255 B1
(45) Date of Patent: May 30, 2023

(54) WATER JUG SAFETY SEAL

(71) Applicant: Walter Bertelsman, Millstadt, IL (US)

(72) Inventor: Walter Bertelsman, Millstadt, IL (US)

( * ) Notice: Subject to any disclaimer, the term of this patent is extended or adjusted under 35 U.S.C. 154(b) by 0 days.

(21) Appl. No.: 17/482,646

(22) Filed: Sep. 23, 2021

(51) Int. Cl.

| | |
|---|---|
| ***B65D 75/00*** | (2006.01) |
| ***B65D 41/32*** | (2006.01) |
| ***B65D 41/34*** | (2006.01) |
| ***B65D 75/58*** | (2006.01) |

(52) U.S. Cl.
CPC ..... *B65D 75/002* (2013.01); *B65D 41/325* (2013.01); *B65D 41/3485* (2013.01); *B65D 75/5855* (2013.01); *B65D 2213/00* (2013.01); *B65D 2275/00* (2013.01); *B65D 2401/25* (2020.05)

(58) Field of Classification Search
CPC ..... B65D 55/0854; B65D 75/002; B65D 41/325; B65D 41/3485; B65D 75/5855
See application file for complete search history.

(56) References Cited

U.S. PATENT DOCUMENTS

| | | | | |
|---|---|---|---|---|
| 2,447,983 | A * | 8/1948 | Little | B65D 41/24 524/37 |
| 5,544,770 | A * | 8/1996 | Travisano | B65D 55/026 215/349 |
| 5,971,183 | A | 10/1999 | Bartsch | |
| 6,029,860 | A | 2/2000 | Donselman et al. | |
| 6,058,636 | A | 5/2000 | Colkmire | |
| 6,167,921 | B1 | 1/2001 | Busick et al. | |
| 8,281,821 | B2 | 10/2012 | Spear et al. | |
| 10,336,599 | B2 | 7/2019 | Miles | |

OTHER PUBLICATIONS

Accuform KWC100 Water Cooler Tape, Do Not Remove Potable Water Seal, 2"H x 55 YD. Product Listing [online]. Copyright © 2021 by Global Equipment Company Inc. [retrieved on Mar. 19, 2021], Retrieved from the Internet <URL: https://www.globalindustrial.com/p/kwc100-water-cooler-tape-do-not-remove-potable-water-seal-2-h-x-55-yd>.

Black chevron 5 gallon water bottle cover water dispenser garrafon water machine agua maquina cozy custom inhibit algae. Product Listing [online] ©2021 Etsy, Inc. [retrieved on Mar. 19, 2021], Retrieved from the Internet: <URL: https://www.etsy.com/listing/189717113/black-chevron-5-gallon-water-bottle?show_sold_out_detail-1&ret-nla_listing_details>.

* cited by examiner

*Primary Examiner* — Anthony D Stashick
*Assistant Examiner* — L Kmet
(74) *Attorney, Agent, or Firm* — Cramer Patent & Design, PLLC; Aaron R. Cramer

(57) ABSTRACT

The bottle safety seal may comprise a safety seal that covers the top of a bottle. The safety seal may prevent contaminants from collecting on exposed non-vertical surfaces of the bottle. As non-limiting examples, the contaminants may be from storing the bottle in a warehouse or other storage area where the bottle may be exposed to dust, dirt, spilled liquids, and other substances. The safety seal may be separable from the bottle such that the safety seal may be removed from the bottle prior to pouring or drinking from the bottle. As non-limiting examples, the bottle may be a water bottle, a wine bottle, a soda bottle, or a juice bottle. The bottle safety seal may be particularly suitable for use on 5 gallon water cooler bottles which may present larger exposed surface areas and may spend longer periods of time in storage before being used.

8 Claims, 3 Drawing Sheets

WATER JUG SAFETY SEAL

RELATED APPLICATIONS

Non-applicable.

FIELD OF THE INVENTION

The present invention relates generally to a safety seal and more specifically to a safety seal for a water jug.

BACKGROUND OF THE INVENTION

Many people around the world enjoy drinking water from water cooler. These water coolers often have a five gallon water jug secured upon the top of the water cooler. Many offices and even some households will have five gallon water jugs delivered weekly.

While this practice is convenient and provides clean and reliable drinking water often times the entire neck of the bottle is dusty or dirty due to exposure or storage. If a user merely uncaps the water bottle and places it into the water dispensing cooler—the dust or dirt may be transmitted into the body of the cooler. In order to avoid this problem a need exists for a way to keep a larger portion of the water bottle neck clean. The development of the water jug safety seal provides a solution to this problem in a manner that is safe and cost effective.

SUMMARY OF THE INVENTION

To achieve the above and other objectives, the present invention provides for a bottle safety seal which has, a safety seal adapted to cover a top of a bottle. The safety seal may be a plastic film that is applied over the top of the bottle when the bottle is filled with a product. The plastic film may be transparent such that one or more labels are applied to the bottle are read through the plastic film. The plastic film may include a plurality of heat shrink properties that the plastic film tightens against the bottle when warm air is blown on the plastic film. The bottle may be selected from the group consisting of a 5-gallon water bottle, a water bottle, a wine bottle, a soda bottle, or a juice bottle.

The safety seal may be adapted to be shaped to fit on the upper half of the bottle which includes a neck, a shoulder, and at least a portion of a body of the bottle. The safety seal may include an inverted funnel and a top portion that surrounds a neck of the bottle, a bottom section that surrounds some or all of the body of the bottle. A middle section may surround a shoulder of the bottle and may transition between a plurality of different diameters of the top portion and the bottom section. The safety seal may include a tear line that is a perforation in the safety seal that creates a weakness in the safety seal. The safety seal may tend to rupture at the tear line when an external force is applied to remove the safety seal. The safety seal may be coupled to a tamper-evident band of the bottle cap. The bottle safety seal wherein removing the tamper-evident band to open, the bottle pulls on the safety seal and may cause the safety seal to separate from the bottle such that the safety seal is removed from the bottle prior to removing the bottle cap. The tear line may align with a pull tab such that pulling on the pull tab to remove the tamper-evident band ruptures the safety seal at the tear line and pulls the safety seal as the tamper-evident band is removed. The safety seal may include a low-tack adhesive to retain the safety seal in place until the bottle is opened.

The low-tack adhesive may adhere the safety seal to the bottle until an external force pulls the safety seal away from the bottle. The bottle may be shipped to a storage area and resides in the storage area long enough to be exposed to one or more contaminants which settle onto the safety seal at one or more non-vertical surfaces of the bottle. The safety seal may prevent a plurality of contaminants from collecting on a plurality of exposed non-vertical surfaces of the bottle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
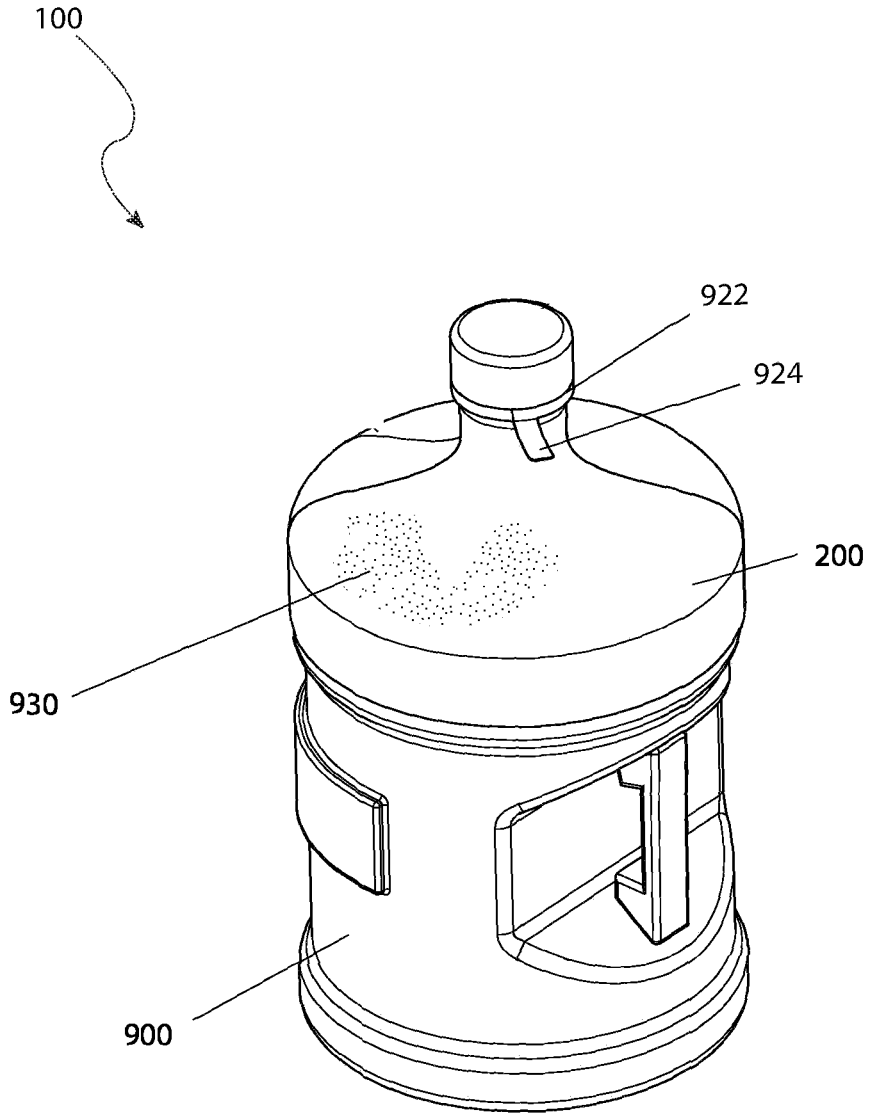
FIG. 1 is an isometric view of a bottle safety seal, according to an embodiment of the present invention.
Figure 2:
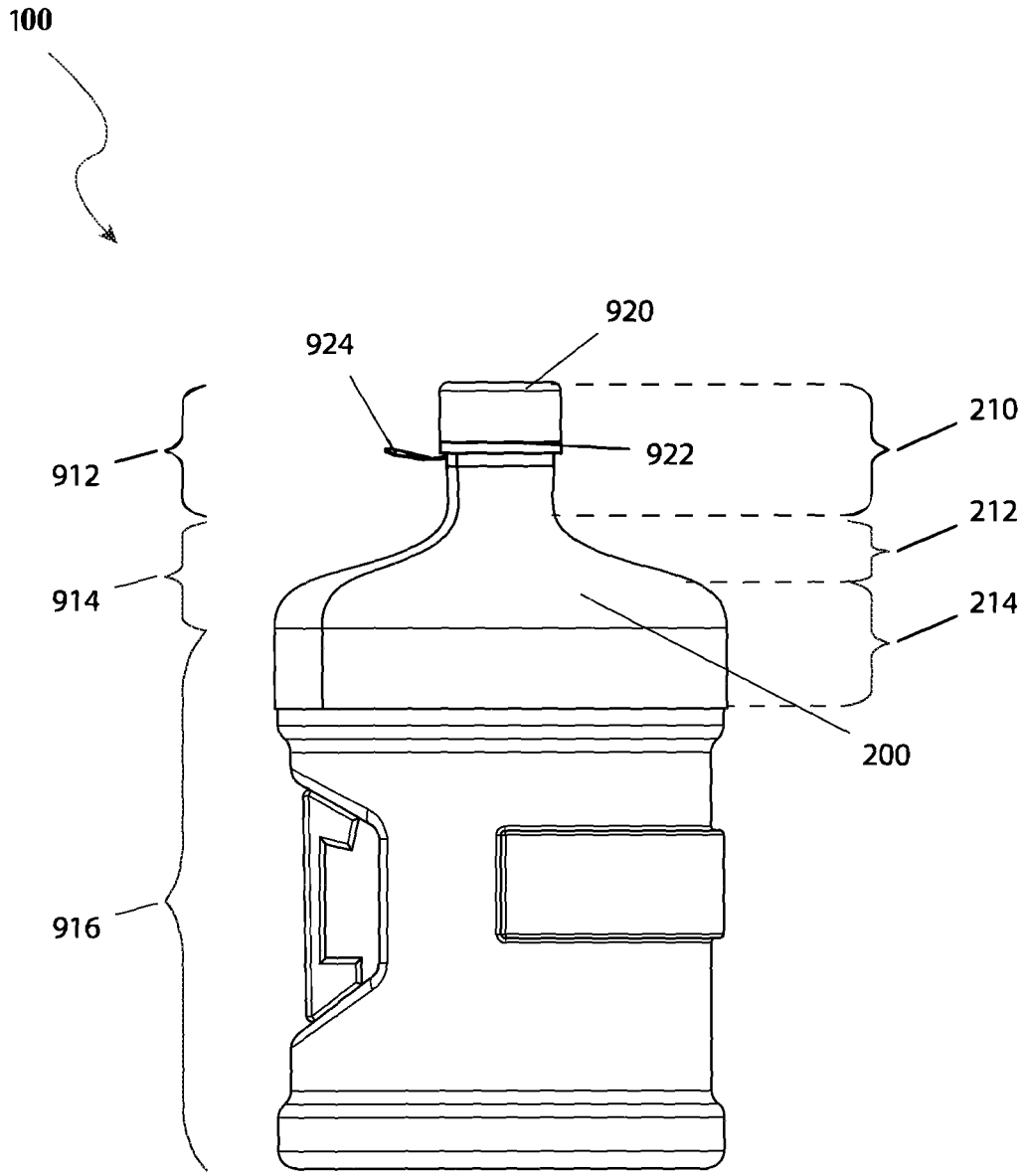
FIG. 2 is a side view of a bottle safety seal, according to an embodiment of the present invention; and, FIG. 3 is a bottom view of a bottle safety seal, according to an embodiment of the present invention; and, FIG. 4 is a top view of a bottle safety seal 100, according to an embodiment of the present invention.
Figure 3:
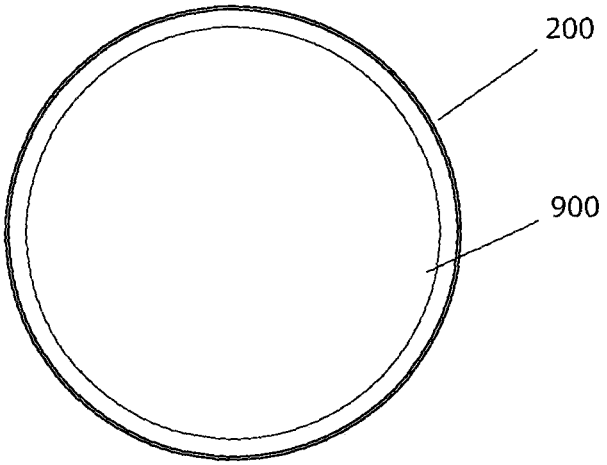
Figure 4:
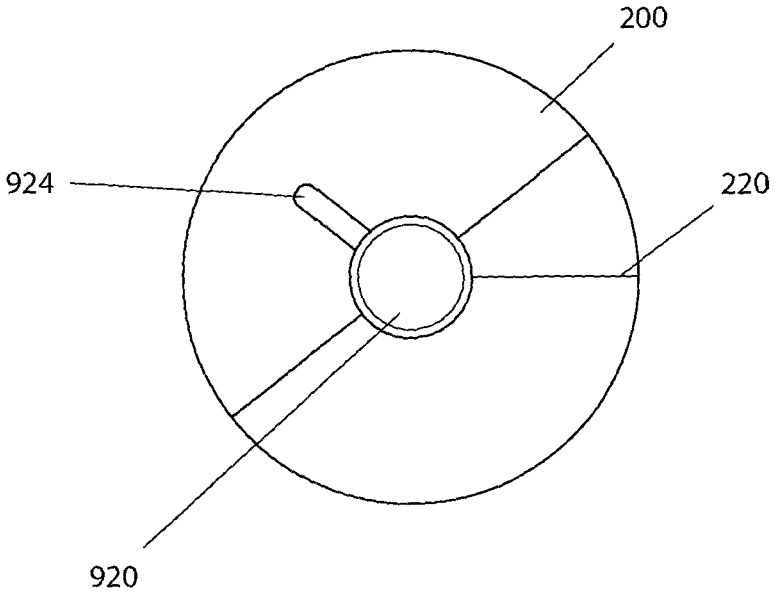

100 bottle safety seal
200 safety seal
210 top portion
212 middle section
214 bottom section
220 tear line
900 bottle
912 neck
914 shoulder
916 body
920 bottle cap
922 tamper-evident band
924 pull tab
930 contaminants

DESCRIPTION OF THE INVENTION

The present invention is directed to a bottle safety seal (herein described as the "invention") 100. The invention 100 may comprise a safety seal 200 that covers the top of a bottle 900. The safety seal 200 may prevent contaminants 930 from collecting on exposed non-vertical surfaces of the bottle 900. As non-limiting examples, the contaminants 930 may be from storing the bottle 900 in a warehouse or other storage area where the bottle 900 may be exposed to dust, dirt, spilled liquids, machinery lubricants, and even urine and feces from pests present in the storage area. The safety seal 200 may be separable from the bottle 900 such that the safety seal 200 may be removed from the bottle 900 prior to pouring or drinking from the bottle 900. As non-limiting examples, the bottle 900 may be a water bottle, a wine bottle, a soda bottle, or a juice bottle. The invention 100 may be particularly suitable for use on five-gallon (5 Gal.) water cooler bottles which may present larger exposed surface areas and may spend longer periods of time in storage before being used.

The safety seal 200 may comprise a plastic film that may be applied to the bottle 900 after the bottle 900 is filled with product. The safety seal 200 may be shaped to fit on the upper half of the bottle 900 which may comprise a neck 912, a shoulder 914, and at least a portion of a body 916 of the bottle 900. The safety seal 200 may generally be the shape of an inverted funnel and may comprise a top portion 210 that surrounds the neck 912 of the bottle 900, a bottom section 214 that surrounds some or all of the body 916 of the bottle 900, and a middle section 212 that may surround the shoulder 914 of the bottle 900 and may transition between the differing diameters of the top portion 210 and the bottom section 214.

In some embodiments, the plastic film may be clear such that labels applied to the upper half of the bottle 900 may be read through the plastic film. In some embodiments, the plastic film may comprise heat shrink properties that such the plastic film may tighten against the bottle 900 when warm air is blown on the plastic film.

In some embodiments, the safety seal 200 may cover a mouth of the bottle 900 prior to a bottle cap 920 being placed over the mouth of the bottle 900.

The safety seal 200 may comprise a tear line 220. The tear line 220 may be a perforation in the safety seal 200 that creates a weakness in the safety seal 200. The safety seal 200 may tend to rupture at the tear line 220 when an external force is applied to remove the safety seal 200.

In some embodiments, the safety seal 200 may be coupled to the bottle cap 920. Specifically, in some embodiments, the safety seal 200 may be coupled to a tamper-evident band 922 of the bottle cap 920. Removing the tamper-evident band 922 to open the bottle 900 may pull on the safety seal 200 and may cause the safety seal 200 to separate from the bottle 900 such that the safety seal 200 may be removed from the bottle 900 prior to removing the bottle cap 920.

In some embodiments, the tear line 220 may align with a pull tab 924 such that pulling on the pull tab 924 to remove the tamper-evident band 922 may rupture the safety seal 200 at the tear line 220 and may pull the safety seal 200 as the tamper-evident band 922 is removed. The pull tab 924 may extend away from the tamper-evident band 922 outside of the bottle cap 920 and the tamper-evident band 922 to facilitate access to grasping the pull tab 924.

In some embodiments, the safety seal 200 may comprise a low-tack adhesive to retain the safety seal 200 in place until the bottle 900 is opened. Low-tack adhesives are known in the art; an example of a low-tack adhesive may be found in off-the-shelf products commonly available in office supply stores where a low-tack adhesive is applied to the back of a slip of paper to create a product useful for posting notes for others to read. The low-tack adhesive may adhere the safety seal 200 to the bottle 900 until an external force pulls the safety seal 200 away from the bottle 900. The external force required to separate the safety seal 200 and the bottle 900 may easily be exerted by the user's hand.

In use, a bottle 900 may be filled with the product and the safety seal 200 may be placed over the top of the bottle 900. The bottle cap 920 may be placed onto the bottle 900 and may be coupled to the safety seal 200. The bottle 900 may be shipped to a storage area and may reside in the storage area long enough to be exposed to contaminants 930 which may settle onto the safety seal 200 at non-vertical surfaces of the bottle 900. The bottle 900 may subsequently be delivered to a user. The user may remove the tamper-evident band 922 of the bottle cap 920 by pulling on the pull tab 924 of the tamper-evident band 922. The pull tab 924 extends externally from the tamper-evident band 922. The process of removing the tamper-evident band 922 may separate the tear line 220 of the safety seal 200 and may begin to pull the safety seal 200 from the bottle 900. The user may complete removal of the safety seal 200 and may discard the safety seal 200. The bottle cap 920 may be removed from the bottle 900 and any portion of the safety seal 200 remaining under the bottle cap 920 may be removed and discarded before pouring or drinking the product from the bottle 900.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A bottle safety seal, consisting of:

a safety seal adapted to cover a top of a bottle and a bottle cap of the bottle;

wherein the safety seal is a plastic film that is applied over the top of the bottle when the bottle is filled with a product;

wherein the plastic film is transparent such that one or more labels are applied to the bottle are read through the plastic film;

wherein the safety seal includes a tear line that is a perforation in the safety seal that creates a weakness in the safety seal;

wherein the safety seal tends to rupture at the tear line when an external force is applied to remove the safety seal;

wherein the tear line aligns with an external pull tab such that pulling on the external pull tab to remove a tamper-evident band ruptures the safety seal at the tear line and pulls the safety seal as the tamper-evident band is removed;

wherein the external pull tab extends away from the tamper-evident band outside of the bottle cap and the tamper-evident band to facilitate access to grasping the pull tab;

wherein the safety seal includes a low-tack adhesive to retain the safety seal in place until the bottle is opened;

wherein the low-tack adhesive adheres the safety seal to the bottle until an external force pulls the safety seal away from the bottle; and wherein the safety seal is coupled to the tamper-evident band.

2. The bottle safety seal, according to claim 1, wherein the plastic film includes a plurality of heat shrink properties that the plastic film tightens against the bottle when warm air is blown on the plastic film.

3. The bottle safety seal, according to claim 1, wherein the bottle is selected from the group consisting of a 5-gallon water bottle, a water bottle, a wine bottle, a soda bottle, or a juice bottle.

4. The bottle safety seal, according to claim 1, wherein the safety seal is adapted to be shaped to fit on an upper half of the bottle which includes a neck, a shoulder, and at least a portion of a body of the bottle.

5. The bottle safety seal, according to claim 1, wherein the safety seal includes an inverted funnel and a top portion that surrounds a neck of the bottle, a bottom section that surrounds some or all the body of the bottle.

6. The bottle safety seal, according to claim 1, wherein a middle section that surrounds a shoulder of the bottle and transitions between a plurality of different diameters of the top portion and the bottom section.

7. The bottle safety seal, according to claim 1, wherein removing the tamper-evident band to open, the bottle pulls on the safety seal and causes the safety seal to separate from the bottle such that the safety seal is removed from the bottle prior to removing the bottle cap.

8. The bottle safety seal, according to claim 1, wherein the bottle is shipped to a storage area and resides in the storage area long enough to be exposed to one or more contaminants which settle onto the safety seal at one or more non-vertical surfaces of the bottle.

* * * * *